United States Patent [19]

Bailey et al.

[11] 4,377,213

[45] Mar. 22, 1983

[54] DUAL BUSHING CENTRALIZER

[75] Inventors: Edward A. Bailey, Newport; James F. Ordway, West Lebanon, both of N.H.

[73] Assignee: Joy Manufacturing Company, Pittsburgh, Pa.

[21] Appl. No.: 298,415

[22] Filed: Sep. 1, 1981

[51] Int. Cl.[3] ..... E21C 7/02

[52] U.S. Cl. ..... 175/211; 175/220

[58] Field of Search ..... 175/209, 210, 211, 220; 173/DIG. 2, 74–80, 57; 181/230; 308/4 A

[56] References Cited

U.S. PATENT DOCUMENTS

| | | | |
|---|---|---|---|
| 1,928,291 | 9/1933 | Kelley | 175/209 |
| 2,107,552 | 2/1938 | Smith | 255/50 |
| 3,045,769 | 7/1962 | Feucht et al. | 175/220 X |
| 3,417,830 | 12/1968 | Nichols | 175/209 |
| 3,598,192 | 8/1971 | Becker | 175/210 |
| 3,788,423 | 1/1974 | Nittinger et al. | 181/33 |
| 3,915,227 | 10/1975 | Simpson | 166/188 |
| 4,182,424 | 1/1980 | Prebensen | 175/211 |

*Primary Examiner*—Stephen J. Novosad
*Assistant Examiner*—Joseph Falk
*Attorney, Agent, or Firm*—Raymond W. Augustin

[57] ABSTRACT

A dual bushing centralizer is provided for a rock drill. The one bushing is provided for stabilizing the rock bit and a second bushing is provided which stabilizes the drill rod. An elastomeric stinger encapsulates both bushings and also provides a noise reduction seal around the drilled hole.

12 Claims, 2 Drawing Figures

DUAL BUSHING CENTRALIZER

This invention relates to a dual bushing centralizer utilized as the front centralizer and stinger on a rock drill for drilling holes, rock, earth strata or the like to reduce the level of noise radiated by operation of the rock drill.

The present invention will be described for the embodiment of a mobile drilling machine jumbo face drill, however, it will be readily apparent to those skilled in the art that the present invention may be used on other rock drills, mobile or stationary, face or deep hole or conventional or jumbo sized. It will also be readily apparent to those skilled in the art that the present invention may be used on rotary rock drills as well as percussion rock drills as described below.

Various mobile drilling machines are commonly referred to as jumbo drills and, although the design of various jumbo drills may vary, essentially all such jumbo drills utilize a drill motor having a reciprocable hammer piston to deliver impact blows to a striking bar or anvil which striking bar is connected to the drill rod so that the drill rod is progressively driven into the strata to be drilled. Such pistons, striking bars and drill rods are metallic members with the drill rod, due to its length, being supported by one or more guides, supports or centralizers. The guides, supports or centralizers are also often metallic. Consequently jumbo drills produce a great deal of noise, such as 112 dBA or above, which is highly undesirable from an industrial health standpoint. In addition, the U.S. government agency, OSHA, has issued standards regarding industrial noise levels which require that a worker not be exposed to a continuously generated noise in excess of 90 dBA (when measured at ear level) for a time weighted average over an eight hour working day. With regard to jumbo drills the standards require a halving of the exposure to noise level per each 5 dBA increase of noise level that is, four hours per working day at 95 dBA, two hours at 100 dBA and so on up to a maximum of fifteen minutes at 115 dBA.

BRIEF SUMMARY OF THE INVENTION

The structure of this invention substantially reduces the noise emanating from the front centralizer and from the hole created by the rock drill. A jumbo drill, however, has various noise sources, the structure of this invention is not intended to reduce the noise level of all such sources, but only the noise emanating from the front centralizer and hole created by the rock drill within the rock or earth strata. The present invention is a dual encapsulated bushing front centralizer with encapsulated bushings referred to as the first encapsulated (or front stinger) bushing and the second encapsulated or the (back) bushing. The first bushing makes contact with the drilling surface and stabilizes the rock bit itself while the rock bit is penetrating the drilling surface and the second encapsulated bushing then stabilizes the drill rod itself. The dual encapsulated bushing allows the centralizer to stabilize the steel system (comprised of the drill rod and drill bit) at the drill bit during initial entry into the drilling surface therefore allowing the rock drill to drill straighter or more true holes. The action of the first encapsulated bushing is especially critical when attempting to drill holes into drilling surfaces when the hole desired to be drilled is non-perpendicular to the drilling surface. The stinger of the dual encapsulated bushing centralizer reduces noise by providing dampening for vibrational forces and sealing off the holes created by the rock drill.

Accordingly one object of this invention is to provide a dual encapsulated bushing front centralizer which can stabilize the steel system around at the drill bit itself to prevent the drill bit from "traveling away" from the desired orientation of the hole caused by uneven drilling surfaces. Another object of the present invention is to provide another separate bushing which stabilizes the drill rod apart from the bushing which stabilizing the drill bit.

Another object of this invention is to provide a dual encapsulated bushing front centralizer which reduces the level of noise emanating from the front centralizer during drilling operations. Another object of the present invention is to provide a stinger which makes contact with the strata to be drilled which deforms to the contour of the strata sealing off the drill rod and the bit contained on the drill rod and the hole created in the strata, thereby sealing off the noise generated therein.

Another object of this invention is to provide a front centralizer with a fluid flow which facilitates easy removal of chips and flushing water herein referred to as drilling effluent. The fluid flow also prevents drilling effluent from escaping the front centralizer towards the structure of the rock drill therefore preventing the chips from binding within the centralizer.

The above and other objects of the invention will become apparent in the following detailed description of the preferred embodiment of an invention. Taken in conjunction with the accompanying drawings which are part of the specification.

DETAILED DESCRIPTION

Figure 1:
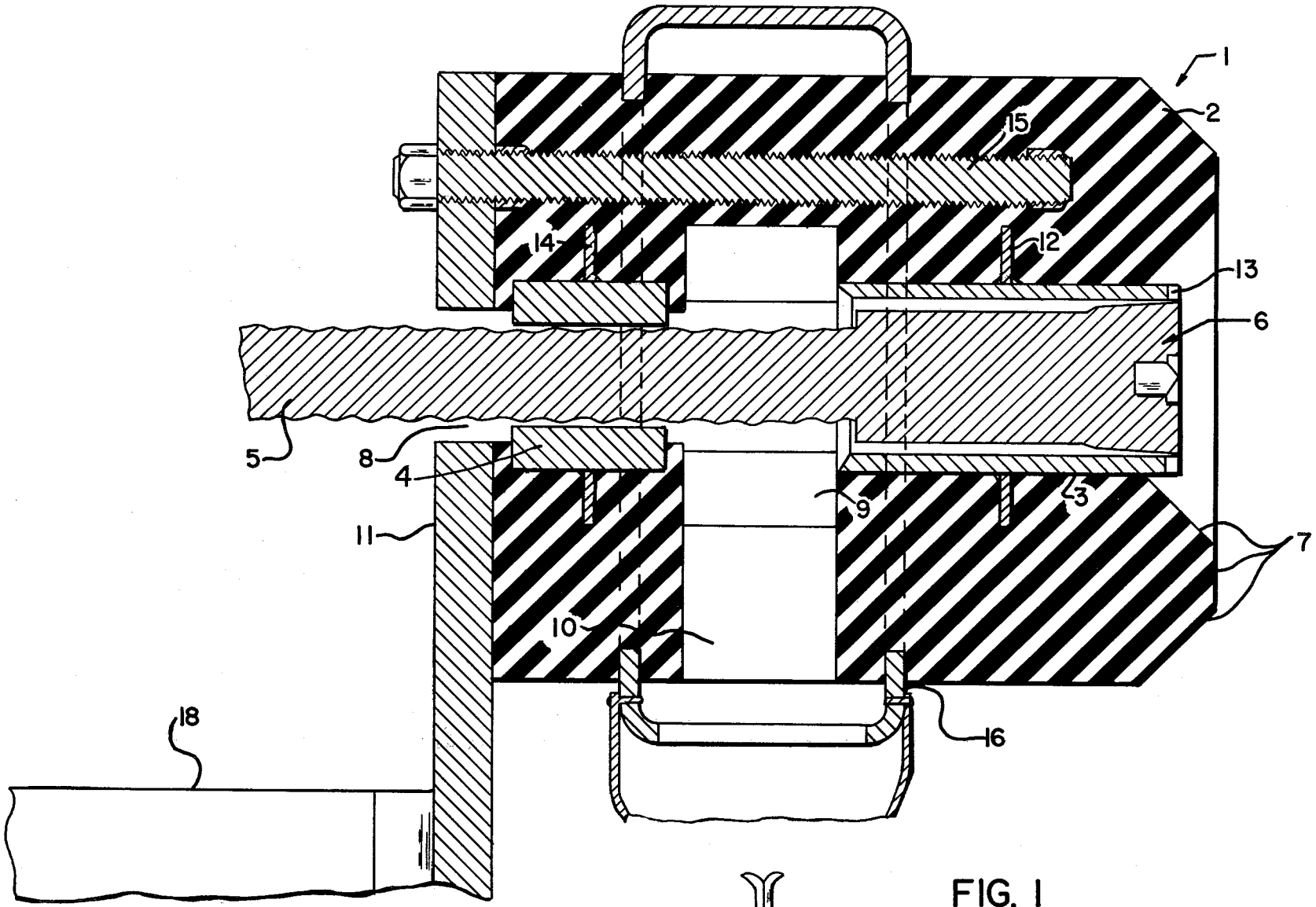
FIG. 1 is a section view of a preferred embodiment of the present invention taken along lines I—I of FIG. 2.

The present invention a dual bushing centralizer is mainly comprised of three basic parts, a stinger, a first encapsulated bushing and second encapsulated bushing. FIG. 1 shows a preferred embodiment of the subject invention. The main body of the centralizer 1 is the stinger 2. The stinger 2 is also the portion of the centralizer which first contacts the rock, strata or environment (hereinafter referred to as drilling surface) to be drilled. The stinger 2 is rigidly attached to the structure of a rock drill feed 18. The stinger 2 is made of a resilient elastomeric material.

By virtue of its elastomeric qualities the stinger 2 reduces noise generated by the centralizer 1 by dampening vibrations generated in the encapsulated bushings 3 and 4 by the drill rod 5 and/or drill bit 6. The stinger also isolates vibrational forces generated in the encapsulated bushings 3 and 4 from the structure of the rock drill feed 18 and vice versa further reducing the noise generated. The stinger 2 also dampens any vibrational forces that may interact between the first encapsulated bushing 3 and the second encapsulated bushing 4.

The stinger 2 has a face 7 toward the drilling surface (not shown) which is capable of deformation, providing a seal about the drill bit 6 at the end of the drill rod 5 when the drill bit 6 engages (sometimes referred to as "stings") the drilling surface. The seal created by the face 7 seals off the drill rod 5 and drill bit 6 as well as the hole (not shown) created by the rock drill. The above sealing action seals off noise emanating from the hole created by the drill bit and drill rod 5. An advantage of the present invention is that the above sealing action can occur on uneven drilling surfaces since the face 7 is deformable.

As shown in FIG. 1 the stinger 2 has an axial bore 8 there through allowing passage of drill rod 5. Intersecting the axial bore 8 and generally centrally located is cavity 9. An aperature 10 is provided with the stinger 2 intersecting with cavity 9 allowing cutting and flushing water or flushing air (hereinafter referred to as drilling effluent) to exit the stinger in a direction generally perpendicular to the axial bore 8. The embodiment shown in FIG. 1 shows the aperature perpendicular to axial bore 8, however, it will be readily apparent to those skilled in the art that the aperature 10 does not have to be at a 90° angle from axial bore 8 and the words "perpendicular to the axial bore" mean that the drilling effluent is exited from the stinger 2 in a direction generally parallel to the drilling surface.

A first encapsulated bushing 3 is provided for engaging the drilling surface and coaxially aligning the drill bit with said axial bore 8 as the drill bit 6 enters the drilling surface allowing a drill bit 6 and drill rod 5 passage there through. The first encapsulated bushing 3 is located within the stinger 2 between the drilling surface and the cavity 9. In operation the rock drill feed 17 forces the stinger 2 against the drilling surface, the face 7 will deform sealing off the first encapsulated bushing 3 and the drill bit 6. The stinger 2 will continue to deform until the first encapsulated bushing 3 makes contact with the drilling surface. FIG. 1 shows the preferred embodiment of the present invention wherein the face 7 is generally closer to the drilling surface than the first encapsulated bushing 3 and the first encapsulated bushing 3 on its cylindrical base toward the drilling surface is provided with gripping means such as a saw tooth surface 13 for engaging the drilling surface. The saw tooth surface 13 aids in its engagement or "stinging" of the drilling surface by the first encapsulated bushing 3. By stabilizing the drill bit and not just the drill rod 5 the present invention allows the rock drill to drill a true hole and decreases the tendency of the rock bit 6 "traveling" from the axial orientation of the desired hole. The above advantage is possible because by stabilizing the drill bit 6 the drill steel is centralized at a point closer to the drilling surface, therefore uneven drilling surfaces will not as easily move the drill bit 6 and drill rod 5 out of their original axis. The stabilizing effect or aligning effect of the first encapsulated bushing 3 on the drill bit 6 is continued as the drill bit 6 penetrates the drilling surface.

A second encapsulated bushing 4 is provided within stinger 2 for coaxially aligning the drill rod 5 with the axial bore 8 allowing the drill rod 5 passage there through. Most of the aligning of drill rod 5 within second encapsulated bushing 4 occurs after the drill bit 7 has significantly penetrated the drilling surface. The second encapsulated bushing is located between the structure of the rock drill feed 18 and the cavity 9. In the preferred embodiment shown in FIG. 1 the second encapsulated bushing is located between the cavity 9 and the base plate 11. The structure of the rock drill feed 18 abuts the base plate 11 opposite the stinger 2. In the preferred embodiment the second encapsulated bushing 4 will also be maintained out of contact with the base plate 11 as well as with the first encapsulated bushing 3.

The material used for either encapsulated bushing 3 and 4 may be any resilient material capable of withstanding the forces exerted upon them by contact with the drill rod 5 and/or drill bit 6. Often the encapsulated bushings 3 and 4 are made of metallic material and often the metal used is steel. FIG. 1 also illustrates the preferred embodiment of the encapsulated bushings 3 and 4 with a peripheral flanges 12 and 14 generally located at the midpoint of the bushings to aid in retention of the bushings within the stinger 2.

Means are provided for rigidly attaching the stinger 2 to the structure of the rock drill feed 18. The structure of the drill feed 18 is usually a boom or other structural piece which holds the centralizers and drill motor. In most drills the structure of the drill feed 18 is provided with means to force the stinger 2 against the drilling environment. Any suitable means may be utilized for rigidly attaching the rock drill to rock drill feed 18. The preferred embodiment illustrated in FIG. 1 has a base plate 11 which is affixed to the structure of the rock drill. The stinger 2 is then rigidly attached to the base plate 11 by encapsulated bolts 15 in said stinger retained to the base plate 11. In other embodiments the stinger 2 may be rigidly attached directly to the rock drill feed structure such by clamping method or by an adhesive method or combination of adhesive and clamping methods.

To facilitate removal of drilling effluent means are provided for supplying a fluid flow within the axial bore 8 of the stinger 2 in a direction towards the drilling surface. As stated before the drilling surface in FIG. 1 is opposite the face 7. In the preferred embodiment shown in FIG. 1 the fluid flow is exhaust air from the pneumatic motor (not shown) used to power the rock drill. The exhaust air enters the stinger 2 along the outside diameter of the drill rod 5 within axial bore 8. The exhaust air then passes through the second encapsulated bushing 4 and enters the cavity 9. The exhaust air entering the stinger 2 prevents drilling effluent from exiting the stinger 2 through axial bore 8 toward the structure of the rock drill feed 18. The exhaust air is allowed to exit the stinger 2 through aperature 10. Other embodiments of the present invention may provide the desired fluid flow by means of suction with a vacuum system connected to discharge boot 16 which is connected to aperature 10.

Figure 2:
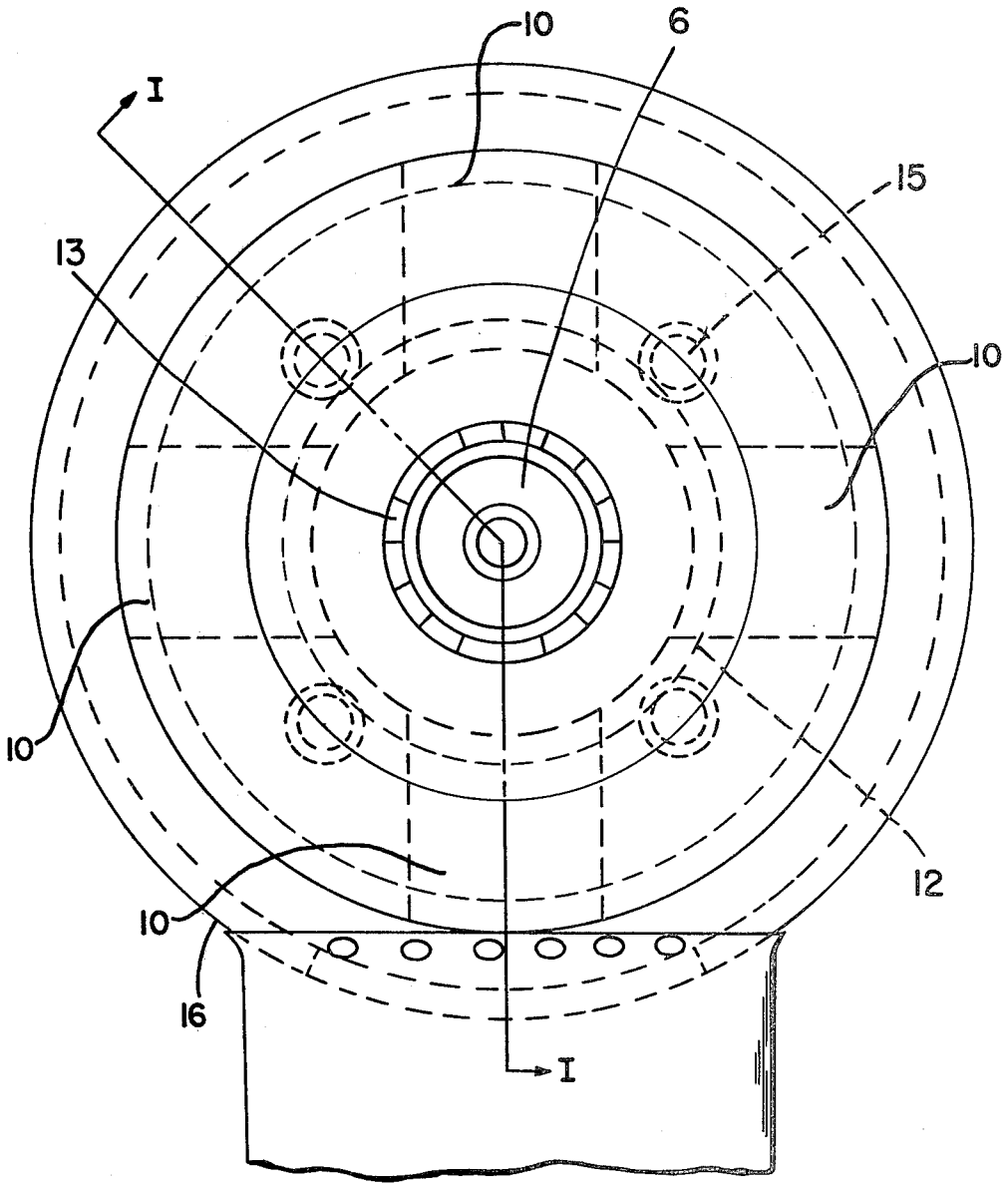
FIG. 2 with the drill bit and drill rod added is a end view of the preferred embodiment present invention.

FIG. 2 is a plan view of the present invention which illustrate a preferred embodiment having four aperatures geometrically positioned with a discharge boot 16 which communicates with the aperature to provide a common removal path for drilling effluent. The discharge boot 16 is rotatable to allow drilling effluent to be removed in all orientations of the structure of the rock drill feed 18.

FIG. 1 shows the preferred embodiment of a three sided face 7. During operation the stinger 2 is forced or biased against the drilling surface. The three sided face 7 facilitates deformation, thereby aids in sealing on non-flat drilling surfaces. After the face 7 has sufficiently deformed to seal the face the saw tooth surface 13 will come into engagement with the drilling surface giving even greater stability for the centralizer 1.

Although the invention has been shown in connection with the preferred embodiment, it will be readily apparent to those skilled in the art that various changes in form and arrangement of the parts may be made to suit requirements without departing from the spirit and scope of this invention.

I claim:

1. A sound insulating rock drill front centralizer comprising:

a stinger rigidly attached to the structure of a rock drill feed comprising a resilient elastomeric material having an axial bore therethrough allowing passage of a drill rod, said stinger also having a generally centrally located cavity intersecting with said axial bore and an aperture intersecting with said cavity allowing drilling effluent to exit said stinger in a direction generally perpendicular to said axial bore, and said stinger having a face toward a drilling surface capable of deformation providing a seal about a drill bit at the end of said drill rod when said drill bit engages the drilling surface;

a first bushing encapsulated within said elastomeric material for engaging the drilling surface and coaxially aligning the drill bit with said axial bore as the drill bit enters the drilling surface, said first bushing allowing a drill bit and drill rod passage therethrough, said first bushing encapsulated within said stinger between said cavity and said drilling surface;

a second bushing encapsulated within said elastomeric material for coaxially aligning said drill rod with said axial bore in said stinger, said second bushing allowing said drill rod passage therethrough, said second bushing encapsulated within said stinger between said rock drill feed structure and said cavity whereby said second encapsulated bushing is maintained out of contact with said rock drill feed structure and said first encapsulated bushing; and means for rigidly attaching said stinger to the structure of the rock drill feed.

2. An apparatus as described in claim 1 wherein the first bushing cylindrical base toward the drilling surface is provided with gripping means for engaging the drilling surface.

3. An apparatus as described in claim 2 wherein the gripping means is a saw tooth surface.

4. An apparatus as described in claim 1 wherein the first bushing and the second bushing are made of metallic material.

5. An apparatus as described in claim 4 wherein the metallic material of the bushing is steel.

6. An apparatus as described in claim 1 wherein the first bushing has an outer peripheral flange.

7. An apparatus as described in claim 1 wherein the second bushing has an outer peripheral flange.

8. An apparatus as described in claim 6 wherein said flange is generally located at the midpoint of said first bushing.

9. An apparatus as described in claim 7 wherein the flange is generally located at the midpoint of said second bushing.

10. An apparatus as described in claim 1 wherein means are provided for supplying a fluid flow within the axial bore of said stinger in a direction toward drilling surface said fluid flow preventing drilling effluent from exiting said axial bore toward the rock drill feed structure.

11. An apparatus as described in claim 1 wherein the means for rigidly attaching said stinger to the structure of a rock drill feed are by a base plate affixed to the rock drill structure, said stinger rigidly attached to said base plate.

12. An apparatus as described in claim 11 wherein the means for rigidly attaching said stinger to said base plate consists of bolts which are encapsulated in said stringer.

* * * * *